US012077923B2

(12) United States Patent
House et al.

(10) Patent No.: US 12,077,923 B2
(45) Date of Patent: Sep. 3, 2024

(54) PRESTRESSED GIRDER FOR CONCRETE BRIDGES WITH AN INCORPORATED CONCRETE OVERHANG AND VERTICAL STAY-IN-PLACE FORM AND METHOD FOR USING SAME

(71) Applicant: BEXAR CONCRETE WORKS, INC., San Antonio, TX (US)

(72) Inventors: Randall H. House, San Antonio, TX (US); Jorge D. Hinojosa, San Antonio, TX (US)

( * ) Notice: Subject to any disclaimer, the term of this patent is extended or adjusted under 35 U.S.C. 154(b) by 0 days.

(21) Appl. No.: 17/096,596

(22) Filed: Nov. 12, 2020

(65) Prior Publication Data

US 2021/0285169 A1 Sep. 16, 2021

Related U.S. Application Data

(60) Provisional application No. 62/990,272, filed on Mar. 16, 2020.

(51) Int. Cl.

| | |
|---|---|
| ***E01D 2/02*** | (2006.01) |
| ***E01D 2/04*** | (2006.01) |
| ***E01D 19/12*** | (2006.01) |
| *E01D 101/24* | (2006.01) |

(52) U.S. Cl.

CPC ..... *E01D 2/02* (2013.01); *E01D 2/04* (2013.01); *E01D 19/125* (2013.01); *E01D 2101/24* (2013.01)

(58) Field of Classification Search

CPC ..... E01D 2/02; E01D 2/04; E01D 19/125; E01D 2101/24

USPC ..... 14/73–78

See application file for complete search history.

(56) References Cited

U.S. PATENT DOCUMENTS

| | | | | |
|---|---|---|---|---|
| 945,439 | A * | 1/1910 | Beidler | E04D 13/14 52/59 |
| 3,357,147 | A | 12/1967 | Lerner | |
| 3,604,167 | A | 9/1971 | Hays | |
| 3,906,687 | A | 9/1975 | Schupack | |
| 4,077,170 | A | 3/1978 | van der Lely | |
| 4,300,320 | A * | 11/1981 | Rooney | E01D 2/00 52/378 |
| 4,564,967 | A | 1/1986 | Vidal | |
| 4,604,841 | A | 8/1986 | Barnoff | |

(Continued)

FOREIGN PATENT DOCUMENTS

| | | |
|---|---|---|
| CN | 1083885 | 5/2002 |
| DE | 000001256671 | 12/1967 |

(Continued)

OTHER PUBLICATIONS

Development of Prefabricated Concrete Bridge Railings by Sri Sritharan, et al.; Quarterly Progress Report, Iowa State University; 24 pages Jun. 30, 2017.

Development of effective precast concrete barrier wall thickness for existing bridge by Basit Sarfaraz, et al.; Journal of Structural Engineering vol. 65A; 10 pages Mar. 31, 2019.

(Continued)

*Primary Examiner* — Raymond W Addie

(74) *Attorney, Agent, or Firm* — Jackson Walker LLP

(57) ABSTRACT

During bridge construction, a form at the upper, outer edge of a bridge's outer girder, upper flange retains concrete slurry poured on the bridge's deck. The girder is cast with extended upper flanges, and the form is precast integrally with the flange. The improved girder may eliminate the need for a construction worker walkway.

17 Claims, 12 Drawing Sheets

(56) References Cited

U.S. PATENT DOCUMENTS

| | | | | | |
|---|---|---|---|---|---|
| 4,672,781 | A * | 6/1987 | Pichon | E01D 19/10 14/78 |
| 4,977,636 | A * | 12/1990 | King | E01D 19/02 52/251 |
| 5,205,087 | A | 4/1993 | Jines | |
| 5,430,903 | A | 7/1995 | Pence | |
| 5,471,694 | A | 12/1995 | Meheen | |
| 5,504,956 | A | 4/1996 | Wiedeck wt al. | |
| 5,577,284 | A * | 11/1996 | Muller | E01D 21/06 52/223.6 |
| 5,893,187 | A | 4/1999 | Fukuoka | |
| 5,930,966 | A | 8/1999 | Wood et al. | |
| 6,145,270 | A | 11/2000 | Hillman | |
| 6,840,706 | B1 * | 1/2005 | Camomilla | E01F 15/043 404/6 |
| 6,857,156 | B1 | 2/2005 | Grossman | |
| 7,069,614 | B1 * | 7/2006 | Sivachenko | E01D 2/00 52/579 |
| 7,104,720 | B2 | 9/2006 | Humphries | |
| 7,373,683 | B2 * | 5/2008 | Moon | E01D 2/02 14/77.1 |
| 7,461,427 | B2 | 12/2008 | Ronald et al. | |
| 7,475,466 | B2 | 1/2009 | He | |
| 7,503,150 | B1 | 3/2009 | diGirolamo et al. | |
| 7,895,799 | B2 | 3/2011 | Hillman et al. | |
| 8,316,495 | B2 * | 11/2012 | He | E04B 5/046 52/223.7 |
| 10,335,707 | B2 * | 7/2019 | Nunes | A63K 1/00 |
| 2006/0283133 | A1 | 12/2006 | Westre et al. | |
| 2009/0282625 | A1 * | 11/2009 | Homsi | E01D 2/02 14/77.1 |

FOREIGN PATENT DOCUMENTS

| | | | |
|---|---|---|---|
| DE | 000002747049 | 5/1979 | |
| DE | 000003928416 | 3/1990 | |
| DE | 000029801562 | 8/1999 | |
| EP | 2929090 | * 10/2015 | E01D 21/00 |
| FR | 2677681 | 12/1992 | |

OTHER PUBLICATIONS

Optimal design for the connector of bridge prefabricated concrete barriers by Xiaolin Yu, et al.; Science Progress 2021, vol. 104(3) I-19; 19 pages Dec. 31, 2021.
Systems Concepts for Precast and Prestressed Concrete Bridge Construction by Arthur R. Anderson; 13 pages 1972.
Precast Aids Fast Track Bridge Replacement Again, Case Study, Ascent, pcl.org; 7 pages Mar. 31, 2005.
Optimized Sections for Precast Prestressed Bridge Girders by Basile G. Rabbat, et al.; PCA R/D Ser. No. 1689; 17 pages 1982.
Accelerated Bridge Construction by John R. Fowler; Canadian Precast/Prestressed Concrete Institute; 21st Century session of the 2006 Annual Conference of the Transportation Association of Canada Charlottetown, Prince Edward Island; 21 pages Sep. 17, 2006.
Moose Creek Bridge, the First Field Application of Fully Prefabricated Bridges in Ontario by Ben Huh, et al.; 2004 Concrete Bridge Conference; 14 pages 2004.
Aspire, The Concrete Bridge Magazine; www.aspirebridge.org; 58 pages 2007.
CPCI Accelerated Bridge Construction, Canadian Precast/Prestressed Concrete Institute; www.cpci.ca; 82 pages.
Long-Span Precast Prestressed Girder Bridges by James R. Libby; PCI Journal; 19 pages Dec. 1971.
Full-Depth, Precast-Concrete Bride Deck Panel Systems, Final Report, by Sameh S. Badie, et al.; NCHRP; 393 pages Nov. 2006.
Impact of LRFD Specifications on Design of Texas Bridges, vol. 1: Parametric Study, by Mary Beth D. Hueste, et al.; Texas Transportation Institute; 387 pages Dec. 2006.
Moose Creek Bridge—Jan. 2005—Project of the Month—Canadian Precast Prestressed Concrete Institute; https://www.cpci.ca/en/about_us/project_month/Jan. 2005/; 7 pages Jan. 2005.
T-beam bridge—RAM/STAAD Forum—RAM/STAAD/ADINA—Bentley Communities, https://communities.bentley.com, 2020.
Solved Q: For The 2-lanes T-Beam Bridge Shown, use AASHTO, Chegg.com.
Moose Creek Girder screenshot, Feb. 26, 2024.
Concrete I-shaped girder screenshot, Google search results, Feb. 26, 2024.
"Desk slab bridge design", Google search results, Feb. 26, 2024.

* cited by examiner

PRESTRESSED GIRDER FOR CONCRETE BRIDGES WITH AN INCORPORATED CONCRETE OVERHANG AND VERTICAL STAY-IN-PLACE FORM AND METHOD FOR USING SAME

This application is based upon and claims priority from U.S. Provisional application Ser. No. 62/990,272, which is incorporated herein by reference.

BACKGROUND OF THE INVENTION

Field of the Invention

Applicant's invention relates to an improved girder for concrete bridges and method for installing and using same. More particularly, it relates to a girder or beam with a widened overhang top flange and a concrete stay-in-place vertical form integrated into the outer upper side of the top flange which functions as a slurry concrete retainer and construction works safety barrier during bridge construction and as the bridge's outer safety wall when the bridge is in use.

Background Information

There are many types of bridges, some of which include truss, arch, beam, tiered arch, suspension, cantilever, and cable-stayed. However, a general description of manufacture of concrete bridges includes a substructure, a superstructure, and a deck.

The type and construction of the substructure is dependent upon the substrate and surrounding elements. For example, a river crossing bridge may have abutments prepared on a riverbank where the bridge end will rest. The substructure may consist of a concrete backwall, which is formed and poured between the top of the bank and the riverbed making a retaining wall for the soil beyond the end of the bridge. A ledge (seat) for the bridge end to rest on is formed in the top of the backwall. Wingwalls may also be needed, extending outward from the back-wall along the riverbank to retain fill dirt for the bridge approaches.

As an additional example, the bridge may rest on columns at support points. The substructure is completed by placing a cap (such as a reinforced concrete beam) perpendicular to the direction of the bridge, reaching from the top of one column to the top of a partner column. In other designs, the bridge might rest on different support configurations such as a bridge-wide rectangular pier or a single T-shaped column parallel sets of T-shaped columns whose upper outer edge are adjacent or multi-girder bridges, the girders connected by one or more upper panels supporting the roadway.

For the superstructure, a crane may be used to set steel or prestressed concrete girders between consecutive sets of columns throughout the length of the bridge. The girders sit on the top of the bent caps.

A standard I-beam is comprised of a central vertical member called the web, a horizontal upper flange connected to an upper end of the web, and a bottom horizontal lower flange connected to the bottom end of the web opposite from the top flange. The I-beam has a longitudinal length from a first end to a second end.

The girders themselves are "I", "U", or box shaped and generally flat at the top of the "I" so that girder provides a flat surface onto which to pour the roadway. With conventional concrete girder bridges, it is common to install girders on the column cap, then manufacture the roadway on the girders. Supported by the girders are various combinations of panels, moister barriers, three-dimensional grids of rebar, concrete, and pavement.

An I-beam's vertical and horizontal orientations are determined by how the I-beam is installed in the bridge. For simplicity, after installation, the web typically has a Y-axis substantially parallel to the bridge roadway and the ground. (This provides a general orientation.) The upper flange is oriented along an X-axis and is generally perpendicular to the web. Further, the top flange is attached at the top of the I-beam, or closer to the bridge roadway, while the bottom flange or fillet is generally perpendicular to the web and is attached at the bottom of the I-beam, or closer to the ground. The fillet is oriented along an X-axis parallel with, but separate from the X-axis that the top flange is oriented along. Thus, upon installation, Earth's gravitational force pulls the I-beam downward along its Y-axis, from the top flange in the direction of the fillet.

The length (along their respective X-axes) of the top flange and bottom flange is called the "width of section." Each of the top flange and bottom flange have a thickness. The web has a thickness. Each of the top flange and bottom flange have an inner surface to which the web is attached, and an outer surface opposite from the web. The distance from the outer surface of bottom flange to the outer surface of the top flange is referred to as the "depth of section."

Conventionally, a roadway bridge has a plurality of I-beams (the number depending upon the width of the bridge). The I-beam, or the length of the I-beam, is perpendicular to the pier caps. Each I-beam is connected at its lower flange, generally at each end of the length of the I-beam, to the top of pier caps. The I-beams are spaced generally evenly across the pier caps. The I-beams are generally uniform with no differences between the beams other than where they happen to be placed.

On a concrete bridge using conventional beams, a temporary walkway along the side of the bridge for bridge construction workers to walk on during bridge construction is sometimes extended outwardly from the side of the bridge. The overhang walkway is often constructed by attaching support brackets at the outside of the bridge usually with bracket bolts inserted into prepositioned bolt holes in the bridge. A plurality of these brackets are installed at regular, often at two feet, intervals. The brackets support the walkway's frame and flooring. It is customary for safety that a railing be installed on the outer side of the walkway. Installing the bracket bolt brackets, the flooring, safety railing and bracket bolts and then, after the bridge is finished, to remove the brackets, the flooring, safety railing and bracket bolts and repair the holes made by the attachment screws or bolts is labor intensive and dangerous.

Because a bridge is raised, side walkways along the sides of the bridge (adjacent to the roadway) may be desirable to provide a platform adjacent the bridge from which the workers may work on the bridge. These walkways are often bordered on the outside by a safety barrier. Even, for a bridge that will not have a permanent walkway after construction, it is often necessary to have a temporary walkway during construction for the workers while they are building the bridge. Support brackets are used to support the walkway from the bridge. The support brackets are placed repeatedly, such as every two feet along the outer edges of the bridge. The support brackets are bolted to the girders with bracket bolts. After the roadway is poured, the bracket bolts and support brackets are removed. The holes left in the girders by the removed support bracket bolts are patched. This process is extremely labor intensive.

Steel panels or precast concrete stay-in-place deck panel slabs are laid across the girders to form a solid platform, completing the bridge deck. An alternative is a stay-in-place steel form to be used with the concrete deck that will be poured later. The deck may include a moisture barrier placed atop the superstructure platform. For example, hot-applied polymer-modified asphalt might be used.

A grid of reinforcing steel bars is constructed atop the moisture barrier; this grid will subsequently be encased in a concrete slab. The grid is three-dimensional, with a layer of rebar near the bottom of the slab and another near the top.

Structural cast-in-place concrete slurry pavement is poured into the concrete retainer forms to create the bridge deck. In a sample embodiment, the deck may have a thickness of 4-12 in (10.16-30.5 cm) of concrete topping, which is required to obtain a composite structural section for the superstructure deck. If stay-in-place forms were used for the deck, the concrete slurry is poured into them to obtain the composite section. If stay-in-place forms were not used, the concrete will be pour on temporary forms that later need to be removed. Concrete slurry could be applied with a slip-form paving machine that spreads, consolidates, and smooths the concrete slurry in one continuous operation. In either case, a skid-resistant texture is placed on the fresh concrete slab by manually or mechanically scoring the surface with a brush or rough material like burlap. Lateral joints are provided approximately every span end, in order to discourage cracking of the deck; these are either added to the forms before pouring concrete or cut after a slipformed slab has hardened. A flexible sealant is used to seal the joint.

A bridge's deck, or roadway, is an elevated part of its superstructure; and is often constructed over another roadway. Its height and relative inaccessibility present more construction challenges than a typical roadway. Many bridge span superstructures incorporate concrete or steel girders on piers. These girders sustain the deck's formwork. Supporting members of the formwork are usually attached in one of two ways: they either hang from the beam's upper flange or they sit on the beam's lower flange. The common features of bridge overhangs—guard rails and sidewalks—are supported by brackets, to support the system.

Generally, for concrete roadway bridges, concrete girders and stay-in-place deck panels are installed and then, in order to complete the bridge deck, the cast-in-place concrete deck is poured. However, in order to shape the bridge deck and contain the slurry concrete, removable overhang forms are used and then removed. The designs of overhang deck forms are generally similar and are often prefabricated with reusable materials.

In many instances, use of formwork systems can help reduce labor and materials costs. Some prefabricated systems provide relatively quick placement. Different companies manufacture various formwork systems to help contractors achieve increased efficiency at jobsites.

Before pouring concrete for the roadway on a bridge deck, deck panels are laid over the girders. The panels provide a relatively flat surface onto which to pour the concrete. Additionally, it is generally advisable to install a framework or grid of reinforcing bars ("rebar") or the like on the panels in order to provide strength and support for the final concrete deck.

To complete the work on a roadway, forms are used to contain and shape the concrete of the bridge deck. Forms for concrete are like molds in that they support and retain concrete in its desired shape until the concrete hardens sufficiently to maintain its desired shape without the forms. No other factor has as much impact on the appearance of the substructure as the quality of the formwork. The forms give shape to the bridge deck itself, as well as traffic barriers along the bridge deck approach ramps, and other concrete structures. The bridge traffic barrier forms provide uniform results that are not only structurally sound, but also aesthetically pleasing. The forms come in standard lengths. Wood and metal are by far the most common form materials. Holes punched in the top tread, base and face allow for additional structures or other implements to be attached to the forms.

Forms must generally meet the following four basic requirements:

1) They must generally be rigid enough to confine plastic concrete at the lines, grades, and dimensions indicated on the plans without bulging or sagging under the load.
2) They must generally be constructed as mortar tight as possible to prevent the loss of concrete ingredients through joints between the form sections.
3) They must generally produce a uniform concrete surface texture, including aesthetic or rustication details when such treatments are specified.
4) They must generally be easy to remove with minimal damage to the concrete surface.

The clearance between the reinforcing bars and the sides of the forms determines the amount of concrete cover over the bars. Forms are not removed until the concrete is strong enough to stand on its own without damage. Deck forms are either removable or stay-in-place deck panel composite permanent forms. Most removable forms are made of wood. Permanent forms are made of metal or precast concrete. Removable wood forms typically consist of ¾ in. exterior-grade plywood sheets for the flooring supported by wood joists and stringers and adjustable metal brackets and hangers. These forms are used with all types of structural members. Joints must generally be filled to prevent concrete leakage. Form faces that come into contact with concrete are generally coated with a coating material so they remove easily and do not mar the concrete surface.

Permanent metal forms are generally steel panels. When steel beams or girders are used as structural members, the panels are supported by metal angles welded or strapped to the top flange depending on whether that portion of the top flange is subject to tensile stresses. Form panels are not allowed to rest directly on the structural steel itself. When prestressed concrete bulb-T, I-beams, or box beams are used, permanent metal forms are supported by adjustable straps or hangers, or by steel inserts cast into the top flange. Form supports are generally not welded to the reinforcement extending from a concrete beam.

A technician must verify that the forms have been installed in such a way that they will produce the required slab thickness and cross-slope at every point along the surface of the deck. The contractor must follow the requirements of the contract drawings and the specifications. The formwork provides a correct and uniformly consistent deck thickness. The contractor installs the deck forms according to the figures marked at the grade points on top of the beams and the degree of cross-slope per foot as specified on the plans.

After making the final adjustments to the screed rails and final checks of the reinforcing bars and forms, the bridge (or a section of it) is ready for concrete placement. A great deal of work has gone into a new bridge by the time the "deck pour" of pouring concrete into the deck forms to create the bridge's deck takes place. The deck pour gets particular attention because the resulting deck is the portion of the bridge which the traveling public will directly contact. Deck smoothness and durability are important. Before the pour, final checks are made for accuracy, form soundness, reinforcement placement, that chamfers and drip edges are properly in place on the copings (outer overhangs), that gaps in the stay in place metal deck forms ("SIP's," also commonly called "pans") are closed, and others. After final preparations, standing water and construction debris are removed before beginning concrete placement. Removable forms that come into contact with plastic concrete are coated with a specially formulated form coating material to prevent adhesion.

Concrete for the bridge deck is placed as close as possible to the area the concrete occupies in the structure. The concrete is placed evenly across the deck from a predetermined drop height. The concrete is poured, finished, and allowed to cure. Removable forms are removed.

During most of this construction process, workers are manually working from or accessing their work stations from the temporary walkway 51 which is hanging from either side of the bridge. Generally, after these above tasks are completed, the temporary walkway is removed. This process is extremely labor intensive because workers must individually remove each of the many brackets, repair each bolt hole and clean excess grout before moving to the next bracket. This process is dangerous because the workers are hanging over the side of the bridge during the removal process, often over speeding automotive traffic.

SUMMARY OF THE INVENTION

As described above, when the bridge deck is poured on a conventional concrete bridge, forms are placed along the edge of the bridge deck in order to create a defined mold in which to pour the concrete bridge deck. The forms hold in and shape the concrete. The improved girder does away with forms by having a pre-cast form, or stay-in-place composite form, because the forms are integrated into the beam on one side of the upper flange (the side intended to be edge of the bridge).

The girder and form are manufactured from concrete, and the form is manufactured as an integral part of the girder's top flange. The form is located on the top, or deck, of the top flange of the girder and adjacent to the edge of the top flange. The form will extend upwardly above the deck. The inner edge of the form (where it extends above the deck) acts as a retaining wall against which slurry concrete can be poured such that the concrete fills over the deck without pouring over the edge of the girder. Thus, depending on the size of the structure (bridge decks are often poured in multiple sections called "pours"), the concrete being poured for the bridge deck could be poured from one side's form to the opposing side's form.

The upper flange of the outside beams are extended such that brackets are unnecessary for the installation of temporary walkways.

The girder may have a drip groove in the top flange's underside near the edge and generally under the form. The drip groove extends for mostly the entire span of the girder. It may be formed in the flange during casting of the girder and flange. When the drip groove is formed, it may be done by placing a line of an easily removable material in the flange mold along the span of the girder, curing the slurry concrete that is poured in the mold to make the girder and flange, and removing the removable material to form the drip groove. The removable material may be a part of the mold itself.

It is anticipated that rebar can be cast inside the precast beam form and extend upwardly and outside the beam form in order to help reinforce the traffic rail.

It should be noted that where an I beam is described or used herein, it is anticipated that a U beam or box beam could also be used.

DETAILED DESCRIPTION OF THE PREFERRED EMBODIMENT

| Ref. | Element |
|---|---|
| 10 | Outer Girder |
| 12 | Inner Girder |
| 14 | Top Flange |
| 16 | Bottom Flange |
| 18 | Deck Panel |
| 20 | Integrated Form |
| 22 | Pier Cap |
| 24 | Inner Girder Top Flange |
| 26 | Inner Girder Bottom Flange |
| 28 | Rail Support Rebar |
| 30 | Drip Groove |
| 32 | Slab |
| 34 | Rebar |
| 36 | Form Inner Edge |
| 38 | Bearing Pad |
| 40 | Threaded Hole |
| 42 | Top Flange Deck |
| 46 | Web |
| 48 | Apertures |
| 50 | Bedding Strip |
| 52 | Threaded Center Marker |
| 54 | Top Flange Underside |
| 56 | Bottom Flange Topside |
| 58 | Bottom Flange Underside |
| 60 | Connector Bar |
| 62 | Form Top |
| 64 | Paving Machine Rail |
| 66 | Girder Center Line ("CL Girder") |
| 68 | Single Slope Traffic Rail ("SSTR") |
| 70 | Field Bend Bar |
| 72 | Inner Girder Top Flange |
| 74 | Inner Girder Bottom Flange |
| 76 | Form Outer Edge |
| 78 | Top Flange Edge |

-continued

| Ref. | Element |
|---|---|
| 80 | Bottom Flange Edge |
| 82 | Construction Joint |
| 100 | Concrete |
| 102 | Traffic Rail |
| 104 | Safety Rail |
| 106 | Bridge |
| 108 | Bridge Deck |
| 110 | Pier Cap |
| 112 | Pier Column |
| Y-Y | Girder Height Axis |
| X-X | Girder Width Axis |
| Z-Z | Girder Length Axis |

Figure 1:
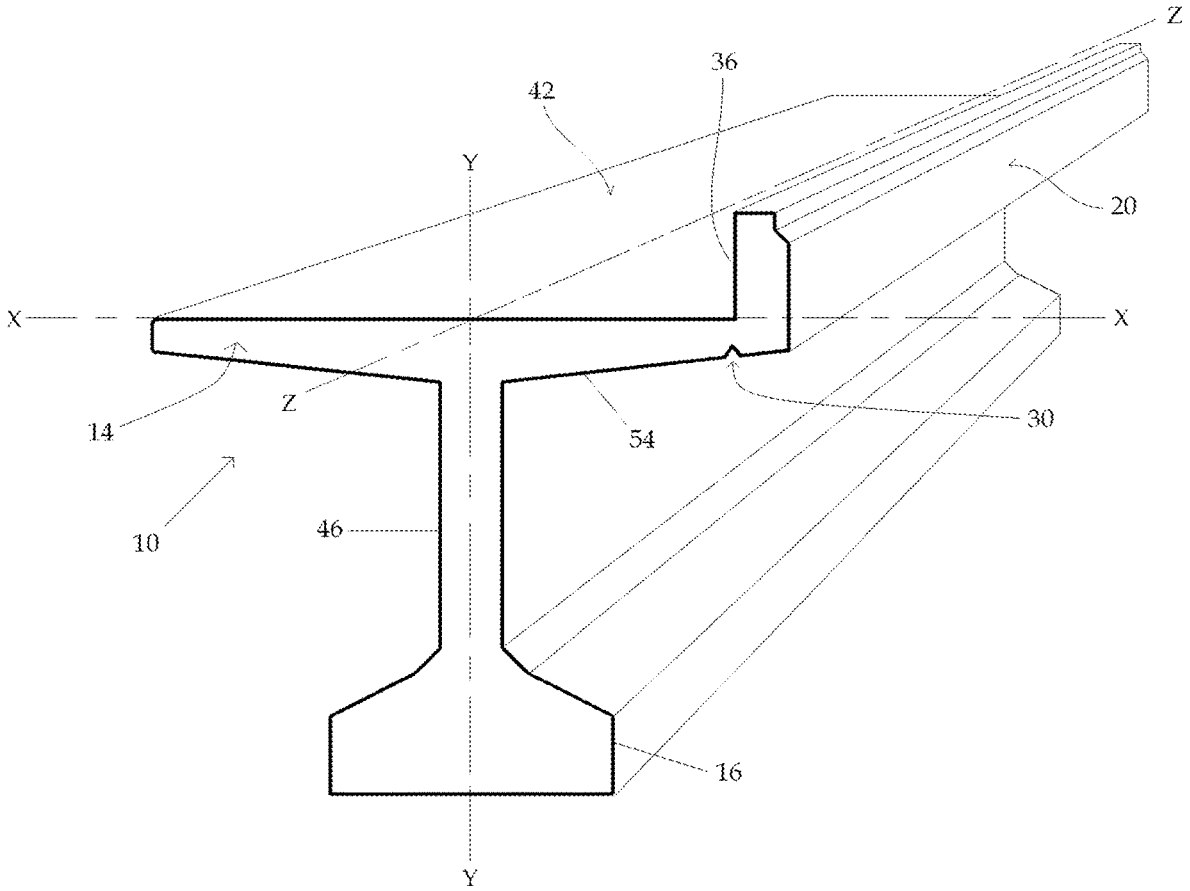
FIG. 1 is a front, perspective view of a girder with an integrated form.

Referring to the figures, FIG. 1 is a front, perspective view of a girder 10 in an "I" beam embodiment. The girder 10 is designed to be one (1) of the two (2) outer girders of a bridge. The girder 10, when in the I beam configuration, is generally configured with a height along the Y-Y axis, a width along the X-X axis and a span or length along the Z-Z axis. An I-beam girder 10, has a top flange 14 that extends from the Y-Y axis outwardly, generally parallel with, the X-X axis. Likewise, it has a bottom flange 16 that extends from the Y-Y axis outwardly, generally parallel with, along the X-X axis. A web 46 extends along the Y-Y axis. The top flange 14 is connected, at or near the center of the width of the top flange 14 (along the X-X axis), to a first end of the web 46*a*. The bottom flange 16 is connected, at or near the center of the width of the bottom flange 16 (along the X-X axis), to a second end of the web 46*b*. Thus, the top flange 14 and the bottom flange 16 are connected to opposing ends of the web 46 (as viewed from the front). This configuration creates the "I" shape for which this embodiment of girders is known.

The girder 10 and integrated form 20, as described herein, are manufactured from concrete 100. As is known and used herein, "manufactured from concrete" does not mean 100% concrete 100 because the girder 10 will include rebar 34 that helps increase the structural integrity of the girder 10, and is used for add-on features such as railings and center-line 66 markers.

The view of this figure illustrates a three dimensional view of the top flange deck 42 and integrated form 20. The integrated from 20 extends upwardly (in the direction of the Y-Y axis) from a first edge of the top flange deck 42*a*, such that the form 20 extends upwardly above said deck 42. It is anticipated that the integrated from 20 will be attached adjacent to the first edge of the top flange deck 42*a* for generally the entire length of the girder 10 along the Z-Z axis, however certain application may require that the integrated from 20 be shortened or that there be gaps. The form 20 is located, sized and shaped so it is capable of retaining slurry concrete 100 poured on the deck 42 of the flange 12 and inward toward the other side of the bridge 106 relative to the form 20. The form 20 has rebar 34 located within the form 20 and some rebar 34 extending out of the upper side of the form 20.

When a pair of girders 10 are paired on opposing edges of a bridge deck 108 with the first integrated form 20*a* of the first girder 10*a* and the second integrated form 20*b* of the second girder 10*b* at the furthest opposing sides of the bridge deck 108, the first integrated form 20*a* and the second integrated form 20*b* create a two (2) sided barrier that holds the slurry concrete 100 in place on the top flange decks 42 and the deck panel 18.

Figure 2:
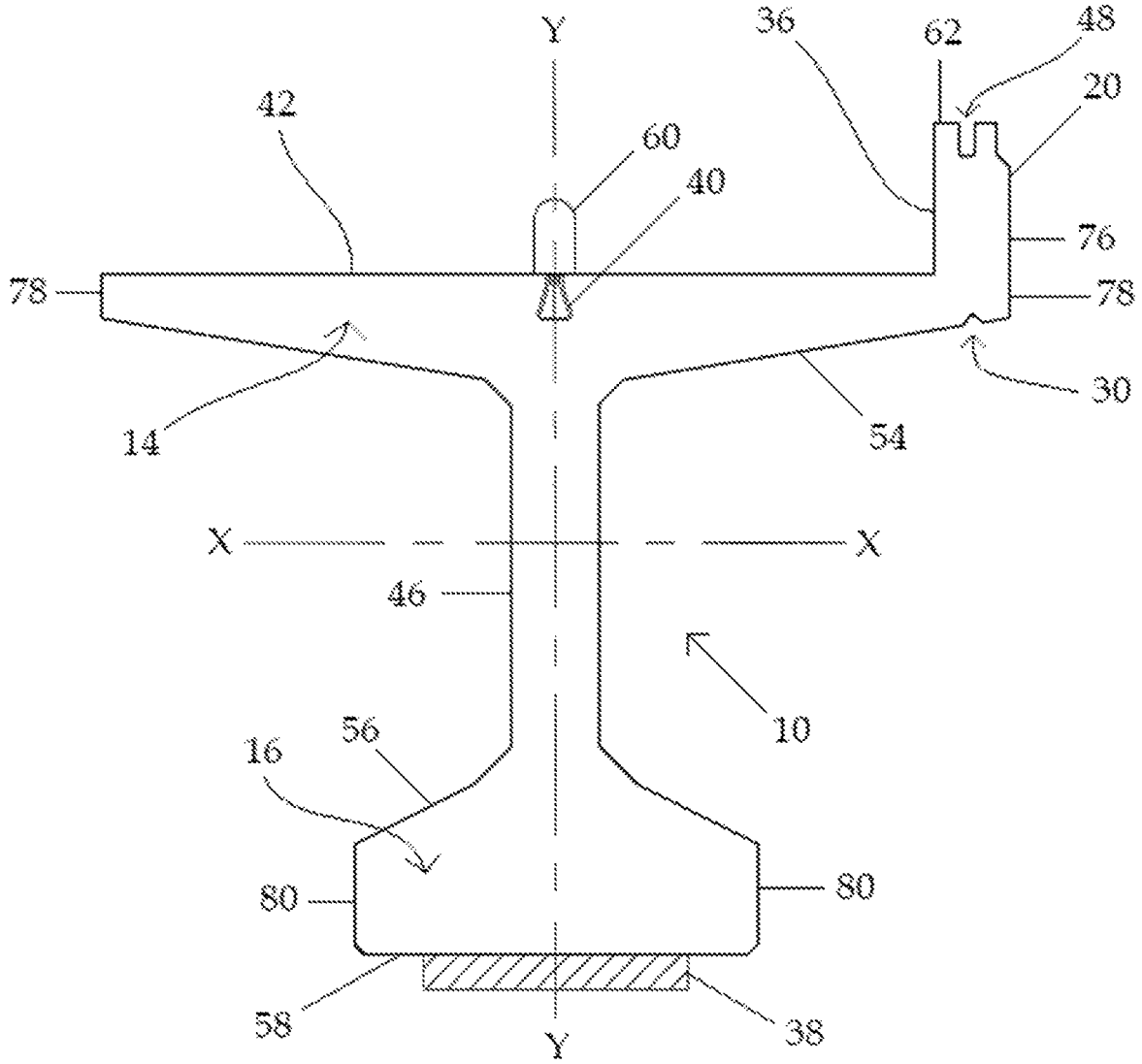
FIG. 2 is a front view of a girder with an integrated form illustrating a first stage in preparing a roadway.

FIG. 2 is a front view of a girder 10. In this embodiment, the girder 10 is an "I" beam style beam where the longer length of the central web 46 runs up and down along the Y-Y axis, and the flanges (14 and 16) extend horizontally to the side, or outwardly from the web 46 along the X-X axis. The girder 10 is installed on a bearing pad 38 at the top of a pier cap 110. The girder 10 is designed to be one (1) of the two (2) outer girders of a bridge.

This figure shows the integrated form 20, outer rebar 34*a* and inner rebar 34*b*. It also illustrates the continuous drip groove 30. The drip groove 30 is sized and shaped to cause water running down and under flange to drip off of flange at the drip groove rather than running down the remainder of the girder. The drip groove 30 is a channel molded or cut into the top flange underside 54 near the top flange edge 78 and generally under the form 20. The drip groove 30 extends for about the entire span of the girder 10.

The outer girder 10 has an extended top flange 14 (in comparison to conventional top flanges and the top flange 24 of the inner girders 12). Viewed from the front of the girder 10, this figure shows the vertical axis Y-Y that extends up the center of the web 46.

The threaded holes 40 interspersed along the girder center line 66 of the top flange deck 42 may be used to connect a threaded insert (not shown) to the top flange deck 42. This figure also illustrates an alternative embodiment in which, rather than installing rebar 34 in the beam form 20 that extends above the beam form 20 for use in building a traffic rail 102, an aperture 48 is formed in the top of the beam form 20. A safety rail 104, or structural portion of a safety rail 104 may be inserted in the aperture 48. Or, other structural components, such as posts (not shown), can be inserted into the aperture 48 for use in building a rail 104.

A threaded anchor hole 40 may be in the deck 42 of the top flange 14. The threaded hole 40 is generally along the Y axis that runs along the center of the web 46. The threaded hole 40 is sized to receive a threaded center marker 52. A concrete deck paving machine rail 64 is attached to the threaded center marker 52, and will be used to act as a marker of the Girder Center Line ("CL Girder") 66 when pouring the concrete slab 32, as well as for determination of depth of the cast-in-place slab 32.

This figure illustrates a first example in a method of preparing a bridge 106 where the outer girder has been attached at the top of a bearing pad 38 where the bearing pad 38 is attached at the top of a pier cap 110.

Figure 3:
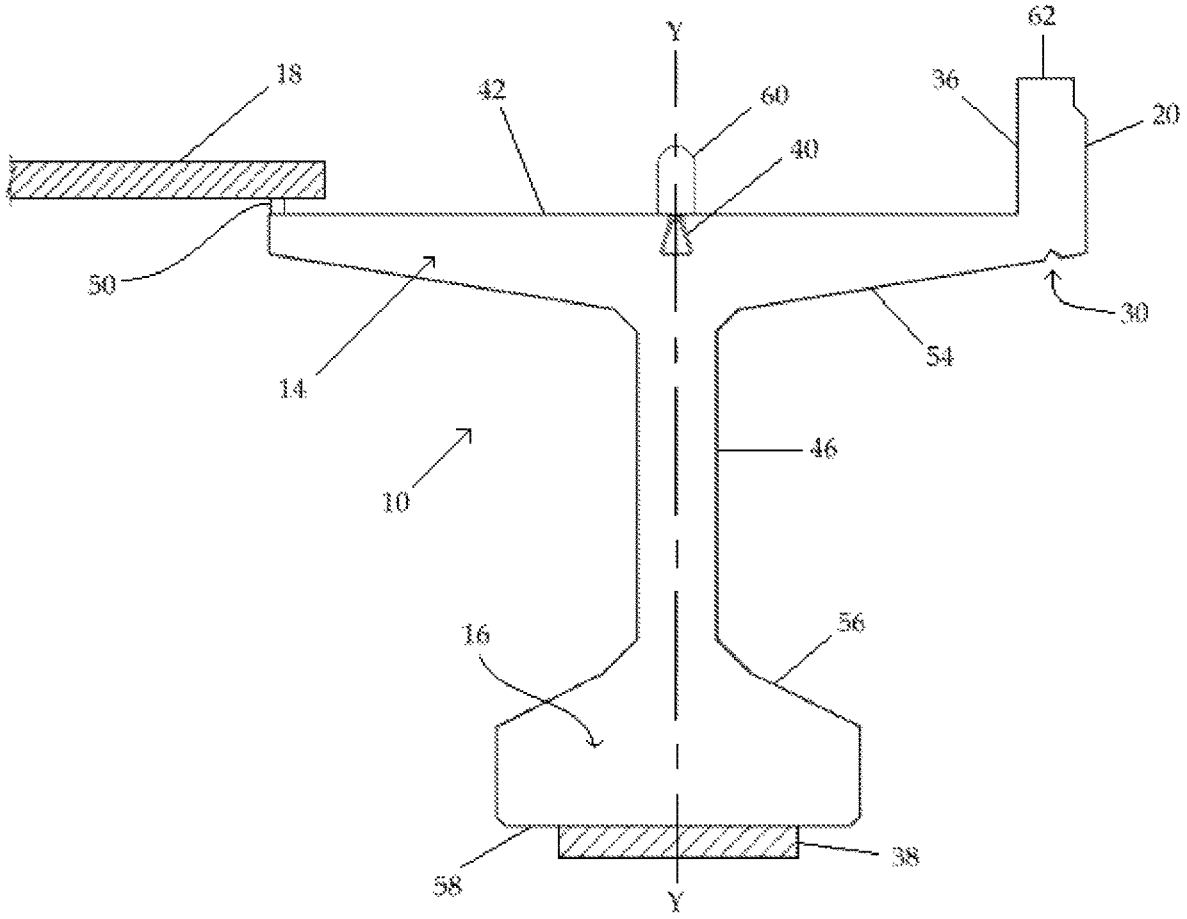
FIG. 3 is a front view of a girder illustrating a second stage in preparing a roadway.

FIG. 3 is a front view of a girder 10 illustrating a second stage in preparing a roadway bridge. A deck panel 18 has been installed and its second edge 18*b* attached on the inner edge 10*a* of the improved girder 10. The deck panel 18 extends to and its first edge 18*a* is attached on a second edge 12*b* of an inner girder 12.

The width (as measured along the X-X axis) of the top flange 14 is wider than the width (as measured along the X-X axis) of the bottom flange 16. The wider top flange 14 is intended to allow a safety walkway to be installed along the outer edges of the bridge 106 without the need for the support brackets (not shown) that are used on conventional bridges in order to support the walkway (not shown) off the outer edge of the bridge 106. The top flange 14 may be in the range of one and a half (1.5) times as wide as the bottom flange 16 to two and a half (2.5) times as wide as the bottom flange 16. Thus, within that range, the top flange 14 may be twice as wide, approximately twice as wide, or at least twice as wide, as the bottom flange 16. Likewise, the top flange 14 may be one and a half (1.5) times as wide, approximately one and a half (1.5) times as wide, or at least one and a half (1.5) times as wide, as the bottom flange 16. However, there is a maximum width of the top flange 14 based upon the diminishing benefits of the wider top flange 14 and increasing forces down on the top flange 14 due to weight on it increasing as the top flange and In one embodiment, some of the dimensions of the girder 10 may be as follows:

The width of the top flange 14 along the X-X axis is 72 inches. The width of the bottom flange 16 along the X-X axis is 32 inches. The top flange edge 78 is 3½ inches thick (along the Y-Y axis), while the top flange underside 58 is 3½ inches thick where it connects to the top flange edge 78 and thickens to 7 inches thick where it connects to the web 46. The web 46 is 7 inches thick (along the X-X axis). The bottom flange 16 is 8¾ inches thick (along the Y-Y axis) at its bottom flange edge 80, while it thickens to 16½ inches thick where it connects to the web 46. The 36 inch width of the top flange 14 as measured from the girder centerline 66 to the form outer edge 76 is 20 inches longer than the 16 inch width of the bottom flange 16 measured from the girder centerline 66 to the bottom flange edge 80. The form inner edge 36 of form 20 extends upward (along the Y-Y axis) from the top flange deck 42, 12 inches. The form 20 is 6 inches wide (along the X-X axis) where it is integrated into the top flange 14 at one of the top flange edges 78. The form outer edge 76 extends upward from the deck 42 at the top flange edge 78, 8½ inches. For the next 1½ inches of rise of the form 20, the width of the form 20 gradually narrows such that at 10 inches in height of the form 20, the width of the form 20 is 4½ inches. The width of form 20 at the very top is 4½ inches. On the top flange underside 54 is a continuous drip groove 30 that is 3 inches from the top flange edge 78. The continuous drip groove 30 is three quarters of an inch and cut or molded into the top flange underside 54 for the entire length or span (along the Z-Z axis) of the outer girder 10.

Figure 4:
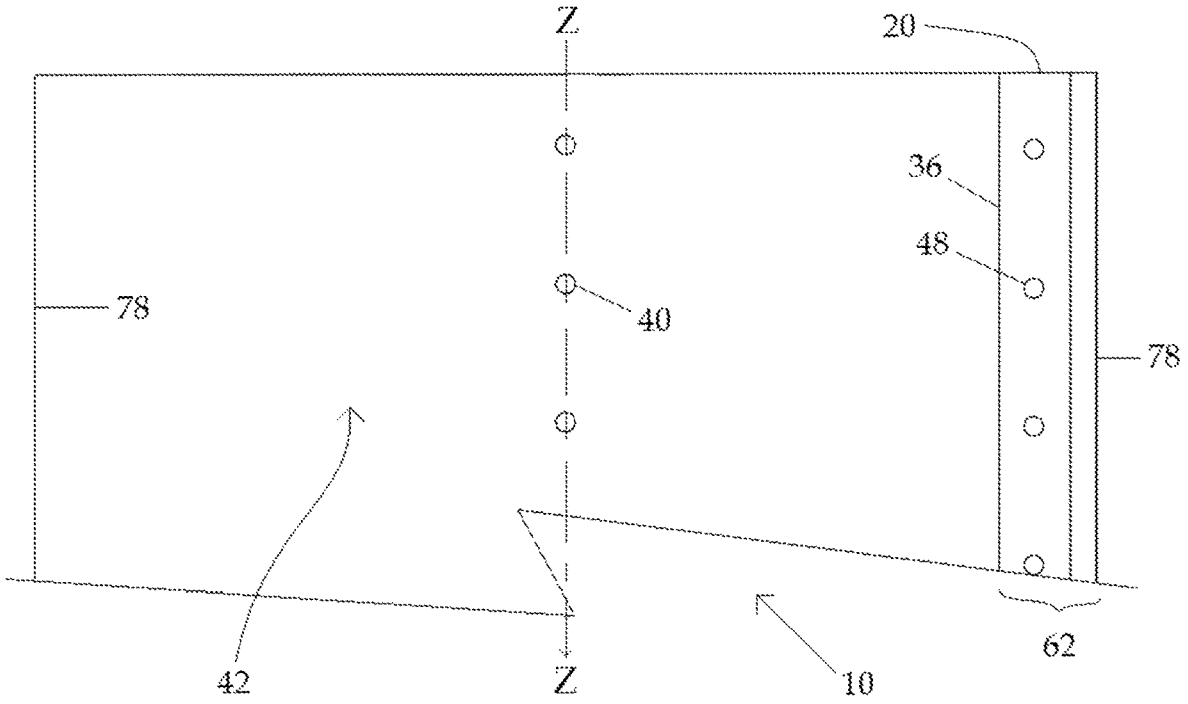
FIG. 4 is a top view of a girder with an integrated form.

FIG. 4 is a top view of an embodiment of a girder 10 and illustrating the top flange deck along a portion of the girder's 10 span or length along the Z-Z axis. The girder's 10 span extends from one pier column 112*a* to the next pair column 112*b*. The threaded holes 40 are spaced along the CL girder 66 and will accept threaded center markers 52 for use by the builders and mapping work along the girder 10. The integrated form 20 is at one top flange edge 78. The apertures 48 are interspersed along the top of the form 20 near the center of the form top 62.

Figure 5:
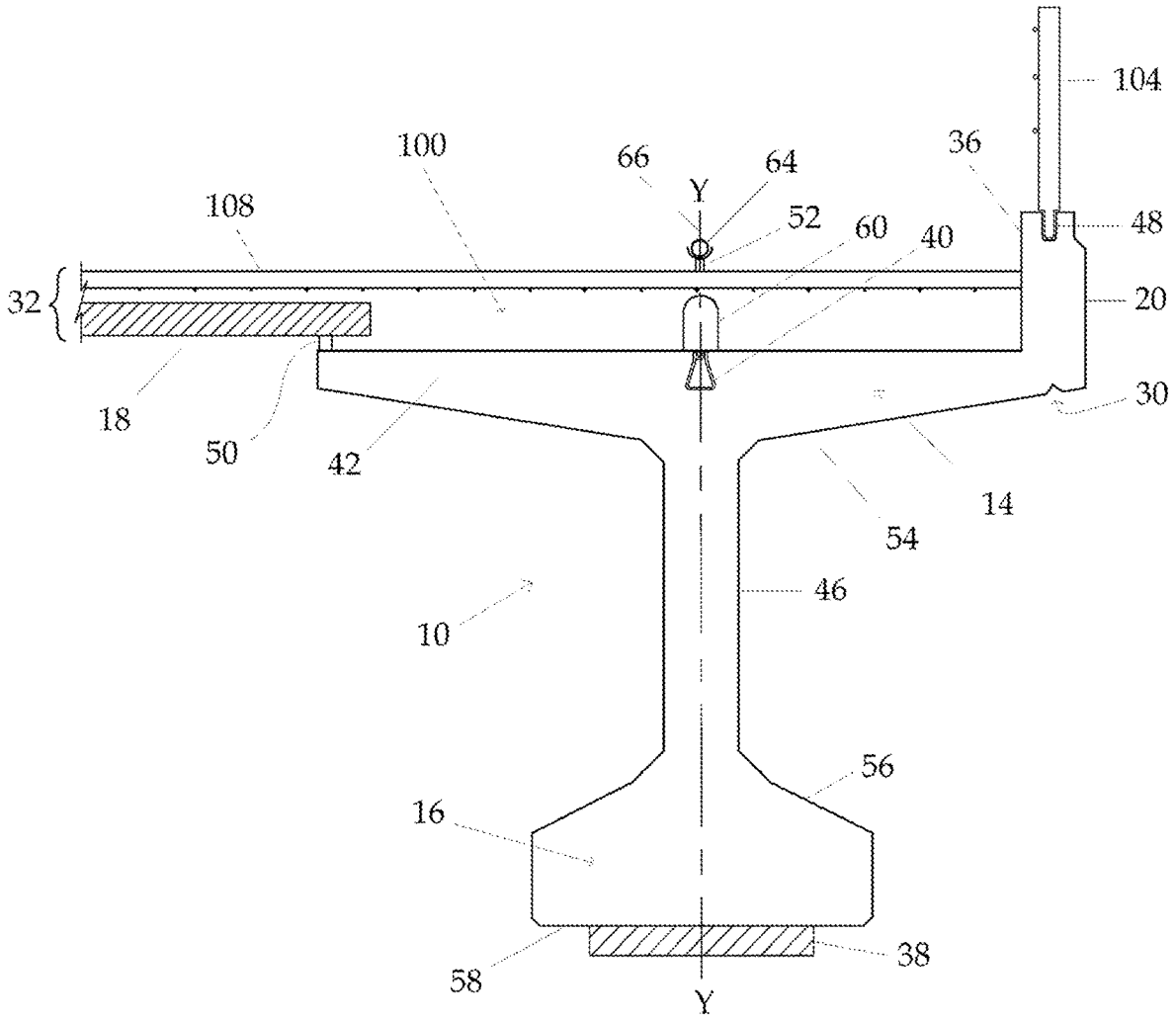
FIG. 5 is a front view of a girder illustrating a third stage in preparing a roadway.

FIG. 5 is a front view of a girder 10 illustrating a third stage in preparing a bridge deck 108. Slurry concrete 100 for a slab 32 is poured over the deck panel 18 and girder 10. The slurry concrete 100 is held in place, during its slurry stage, by the beam form 20. In this embodiment, a threaded center marker 52 supports a paving machine rail 64 near the CL girder 66. A safety rail 104 has been inserted into aperture 48.

As shown in FIGS. 2, 4, and 5, form 20 is located on the upper side of bridge deck 108 and adjacent to the first or second end of said top flange 14. Form 20 extends upwardly above bridge deck 108; is a precast concrete portion of the precast concrete girder 10; has a multiplicity of precast concrete apertures 48 located near the center of the top of form 20. Apertures 48 extend downward into form 20. At least some of apertures 48 are located along the length of form 20 and not at the ends of form 20. At least some apertures 48 are equidistant from other apertures 48 on top of form 20; a safety rail 104, as a upper vertical portion and lower bottom posts. Apertures 48 are located, sized, and shaped, and the safety rail posts are located, sized, and shaped so some of the posts fit within at least some of the apertures 48 and extend downward into form 20. At least some of the posts are inserted into at least some of the apertures 48 and hold the safety rail 104 vertically above form 20. As shown in FIG. 5, the top of the upper vertical portion of the safety rail 104 is further above bridge deck 108 than the top of form top 62 is above bridge deck 108. As shown in FIG. 5, the top of the upper vertical portion of the safety rail 104 is at least three times higher above bridge deck 108 than the top of the form is above bridge deck 108.

Figure 6:
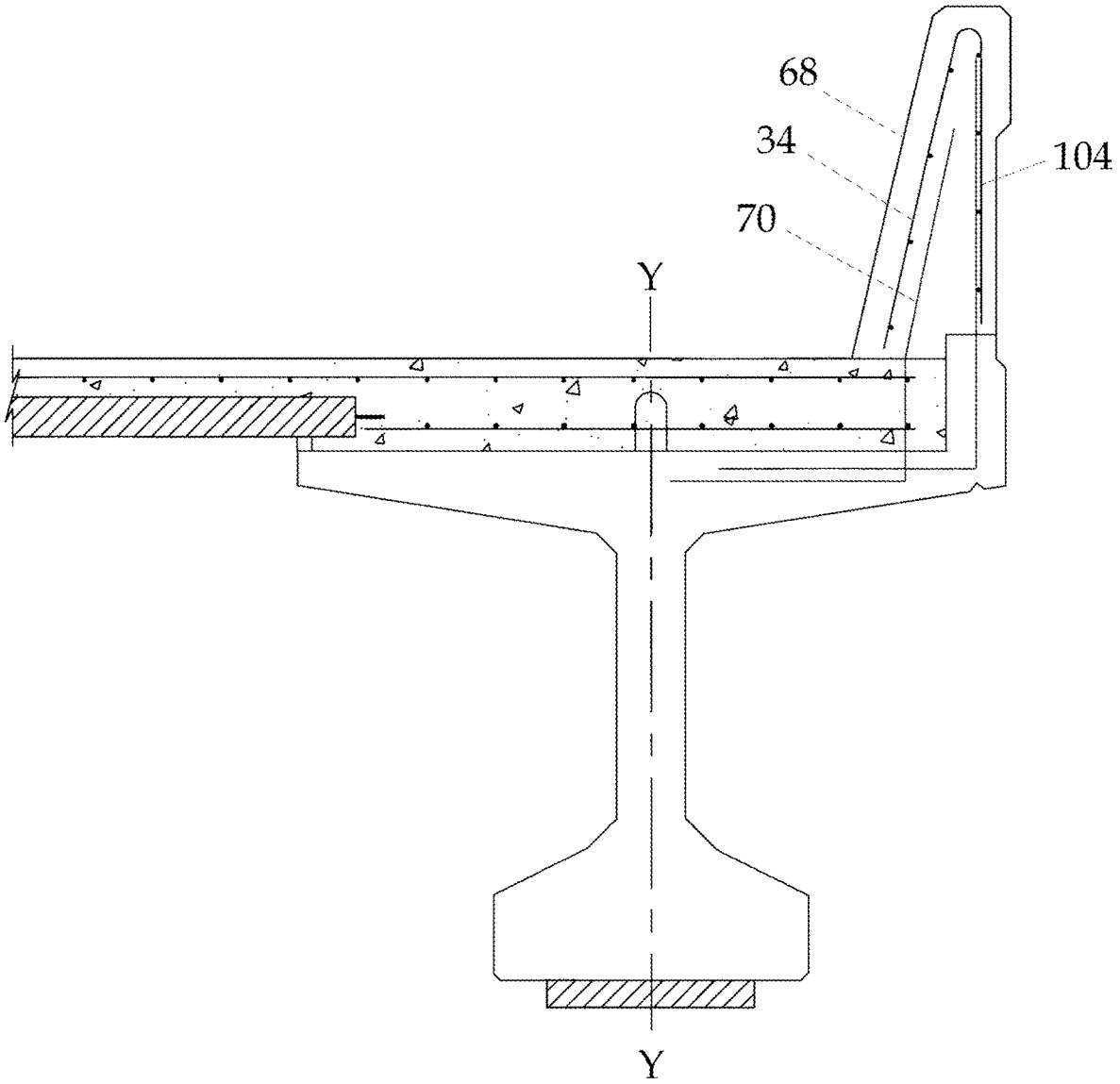
FIG. 6 is a front view of a girder illustrating a fourth stage in preparing a roadway.

FIG. 6 is a front view of a girder 10 illustrating a fourth stage in preparing a bridge deck 108. A safety rail 104 has been installed, and the bridge deck 108 and cast-in-place ("CIP") slab 32 finished. Rebar 34 is often used as support in the top flange 14 as is common in concrete structures, and can extend upwardly from within the retainer barrier or form 20. The field bend bar 70 is a reinforcing bar bent to a prescribed shape such as a truss bar, straight bar with end hook, stirrup, or column tie. Concrete 100 is poured and molded about the field bend bar 70 in order to make the single slope traffic rail ("SSTR") 68.

Figure 7:
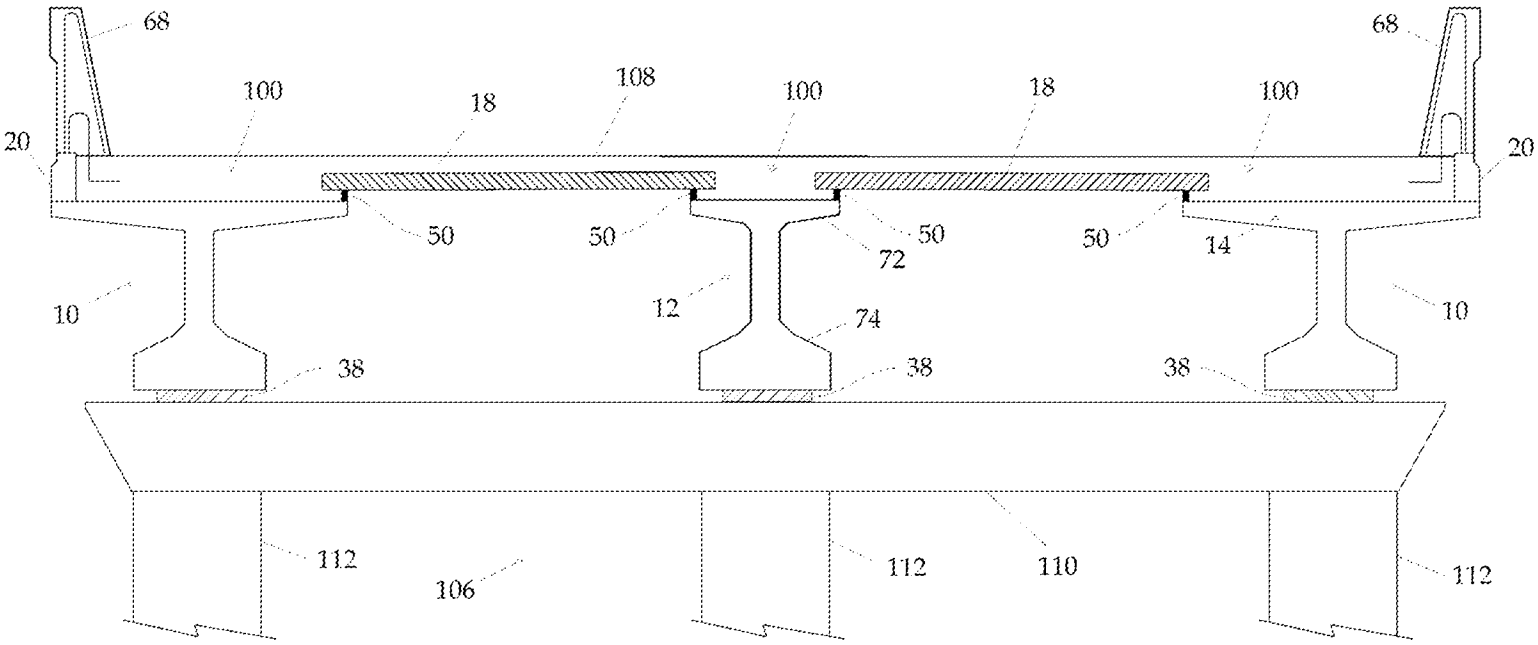
FIG. 7 is a front view of a bridge with girders illustrating a fifth stage in preparing a roadway.

FIG. 7 illustrates an outer girder 10 with an integrated form 20, at a fifth stage in preparing a bridge deck 108. Generally, a bridge 106 is comprised of, in part, two (2) opposing outer girders 10, and may have any number of inner girders 12, depending upon the width of the bridge 106 and its weight bearing requirements.

In this figure, an outer beam, or girder 10, and an inner beam, or girder 12, are shown. The inner beam 12 is an I-beam type girder of conventional construction with the width of section of the inner girder top flange 24 being generally equal to the width of section of the inner girder bottom flange 26. In contrast, the improved beam 10 has a width of section of the top flange 14 that is large than the width of section of the bottom flange 16. The bottom flanges (16 and 26) of both beams (10 and 12) would be attached at the top of a pier cap 22. A deck panel 18 is placed at adjacent ends (10*a* and 12*b*) and on top of the beams (10 and 12) across the gap between the inner beam second end 12*b* and the outer girder first end 10*a*. At the outer edge 10*b* of the outer beam 10 is an integrated form 20. Concrete 100 can be poured over the deck panel 18 and top flange 14, and the outer girder's 10 vertical side integrated form 20 will hold the concrete 100 (in its slurry stage) in place. The integrated form 20 acts as a retainer barrier and extends upwardly from the top, outer flange 14*b*. Slurry concrete 100 poured over the deck panel 18 and top flange 14 is retained by the form 20, or retainer barrier, and becomes the slab 32. The integrated form 20 may have rail support rebar 28 in the integrated form 20 that extends upwardly from inside the integrated form 20 to outside the integrated form 20. This rebar 28 will be used to structurally reinforce the traffic rail (not shown).

The outer top flange 14 and integrated form 20 are preferably made as a precast unitary, concrete unit with rebar 28 extending from the form 20.

In an illustrative bridge construction, an edge slurry concrete retainer form is thirty feet (30') long. Construction workers who must have a place from which to work. This work is done at the elevated dangerous edge of the bridge and while the workers are standing on a temporary construction walkway attached to the edge of the bridge. Conventionally, safety brackets and walkways are installed on the edge of the bridge. The conventional overhang formwork typically requires support brackets to support construction worker walkways. Installing and removing such brackets and safety walkways is a dangerous and labor intensive process where construction workers must work at the dangerous edge of the bridge, as well as when they are removing the concrete retainer form.

In an embodiment, the improved form is pre cast integrally with the upper flange. This eliminates much time consuming and dangerous work on the bridge. In an embodiment, the form is cast in place on the bridge. In this embodiment, the bridge panel or flange is delivered with upwardly protruding rebar and the retainer barrier is formed by pouring slurry into a retainer barrier form incorporating the flange's rebar.

In an alternative embodiment, the retainer barrier is pre cast as a separate unit and sealed to the deck or flange after they are installed at the bridge site, taking advantage of protruding rebar to secure the retainer barrier to the bridge.

An anticipated method of building a bridge in which includes attaching a first outer girder, having a first integrated form on a first top flange, to a first upper side of the bridge and adjacent to a first outer side of the bridge, wherein the first integrated form is positioned adjacent to the first outer side of the bridge. Attaching a second outer girder, having a second integrated form on a second top flange, to a second upper side of said bridge and adjacent to a second outer side of said bridge, wherein said second integrated form is positioned adjacent to said second outer side of said bridge. Depending upon the intended width of the bridge, interior girders may be placed on the upper side of the bridge between the outer girders. As described previously, the girders and integrated forms are each made of concrete. The integrated forms each have rebar protruding from the form top of the integrated forms. The rebar is sized and shaped to be capable of having a single slope traffic rail formed about it. Deck panels are placed such that they span from the first outer girder to any interior girders, and to the second outer girder. Slurry concrete 100 is poured over the deck panels, the interior girders, and the first and second outer girders, and between the first form and the second form. The first and second forms each retain the slurry concrete 100 between them without the use of a removable slurry concrete retainer on the bridge's sides. The slurry concrete is cured in place. And, the bridge construction is completed without removing the first and second retainer barriers. The bridge is completed without attaching a walkway retainer brackets and temporary walkway to the bridge.

Figure 8:
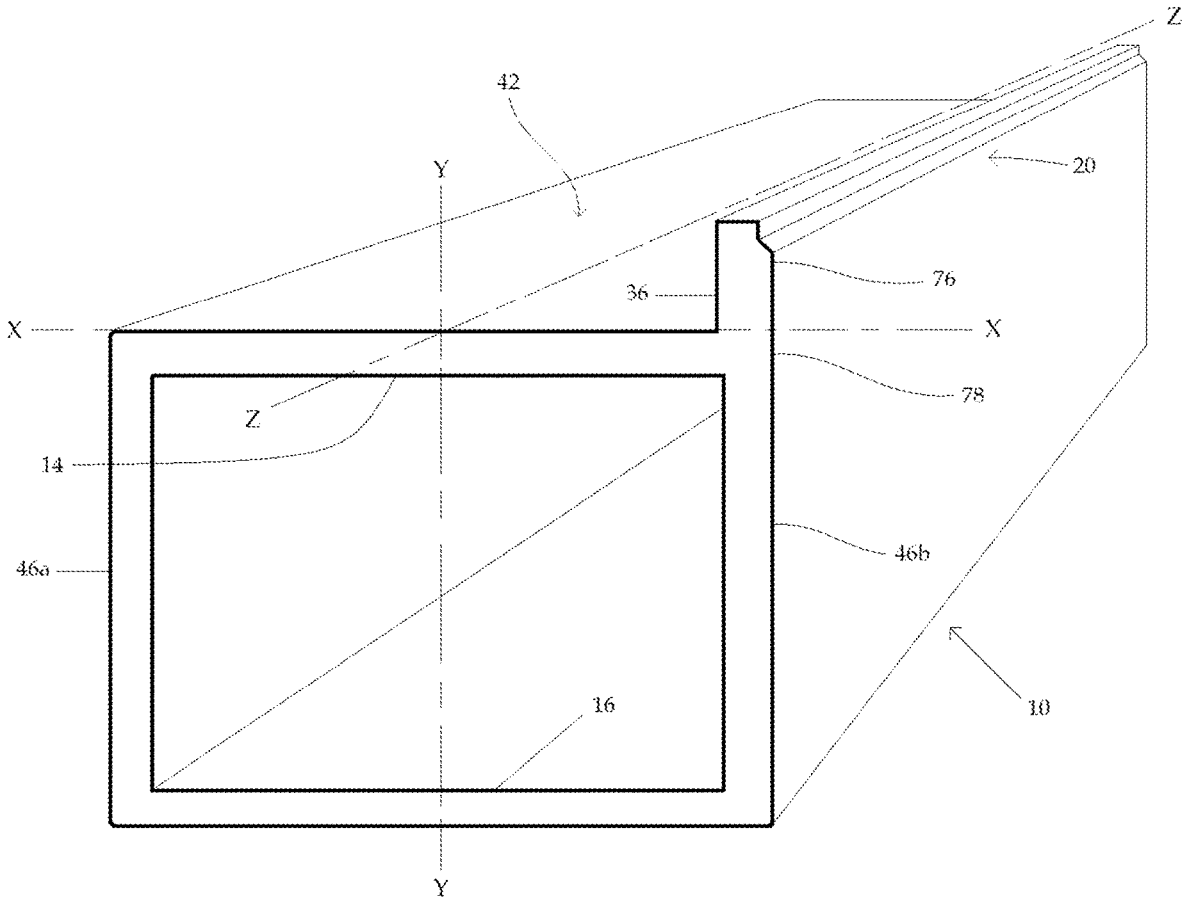
FIG. 8 is a front view of a girder and illustrates the form cast with a box type girder.

FIG. 8 illustrates the form 10 cast with a box type girder 10. Where any girder or I-beam type girder is described or used herein, it is anticipated that other girder types such as a U beam or box beam could also be used with necessary provisions for the different shapes of the girder 10. As illustrated in this figure, the top flange 14 and bottom flange 16 are arranged the same relative to each other as illustrated herein with "I" type girders 10. Likewise, the form 20 is integrated into the girder 10 on the top flange deck 32 at or near the top flange edge 78. The form still operates to hold liquid concrete slurry 100 in place while it dries and hardens.

Figure 9:
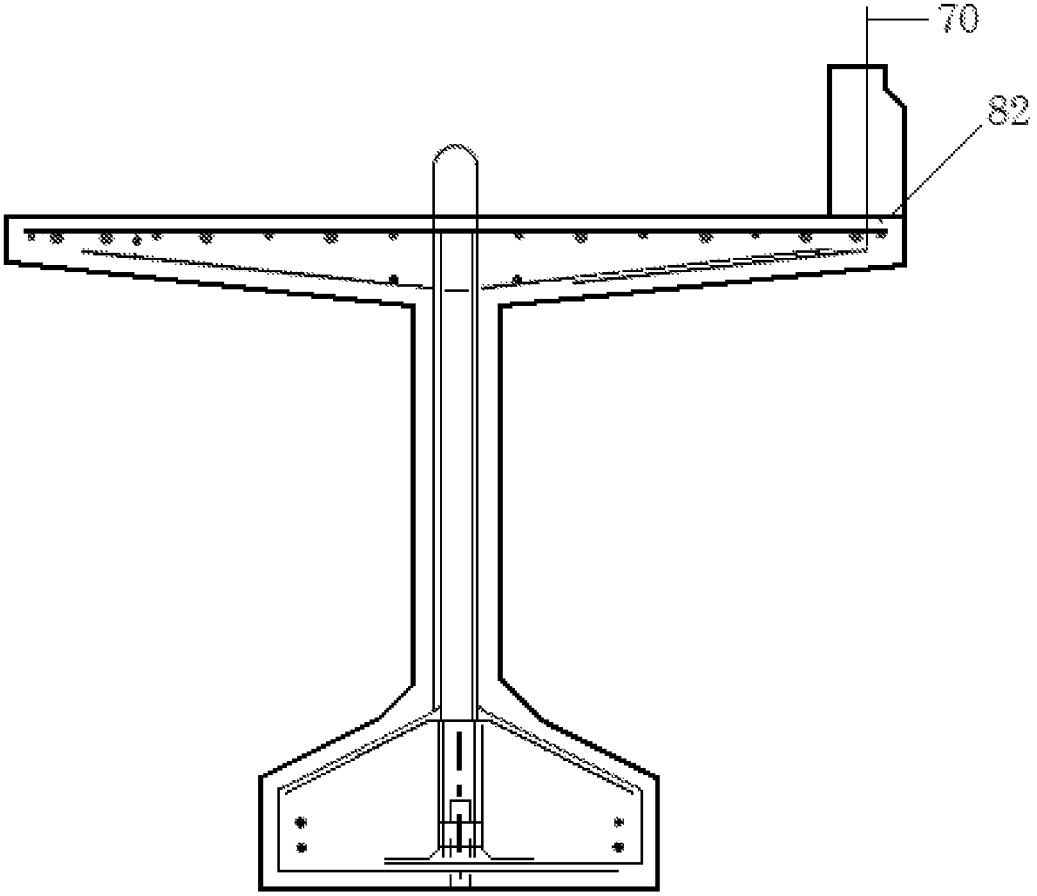
FIG. 9 is a front, cut-away view of a girder illustrating a first embodiment.

FIG. 9 is a cutaway of a front view of the girder 10. A construction joint 82 may be manufactured into the girder 10 generally at a point between the form 20 and the top flange deck 42.

Figure 10:
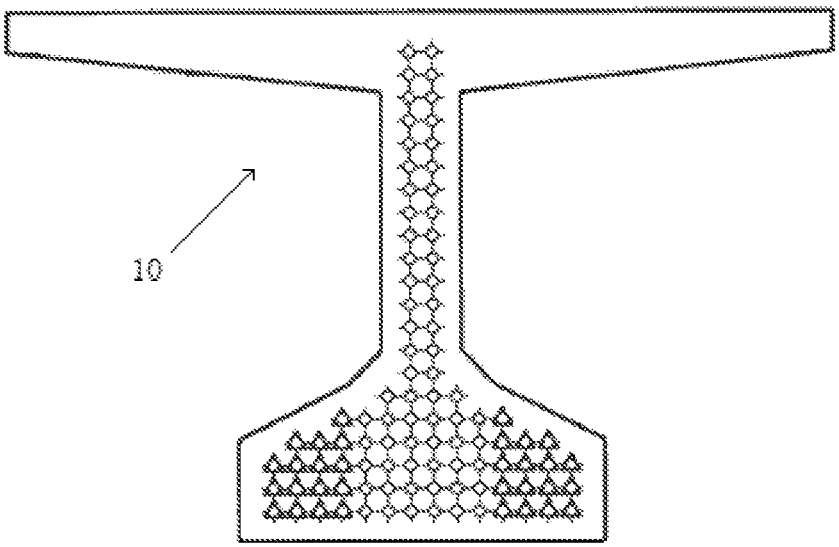
FIG. 10 is a front, cut-away view of a girder illustrating a second embodiment.

FIG. 10 is a cutaway of a front view of the girder 10 with a second embodiment.

Figure 11:
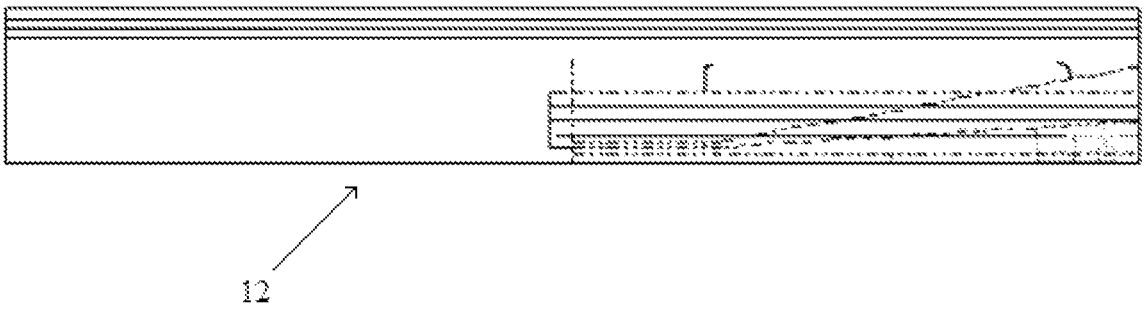
FIG. 11 is a side, cut-away view of a girder.

FIG. 11 is a cutaway of a side view of the girder 10.

Figure 12:
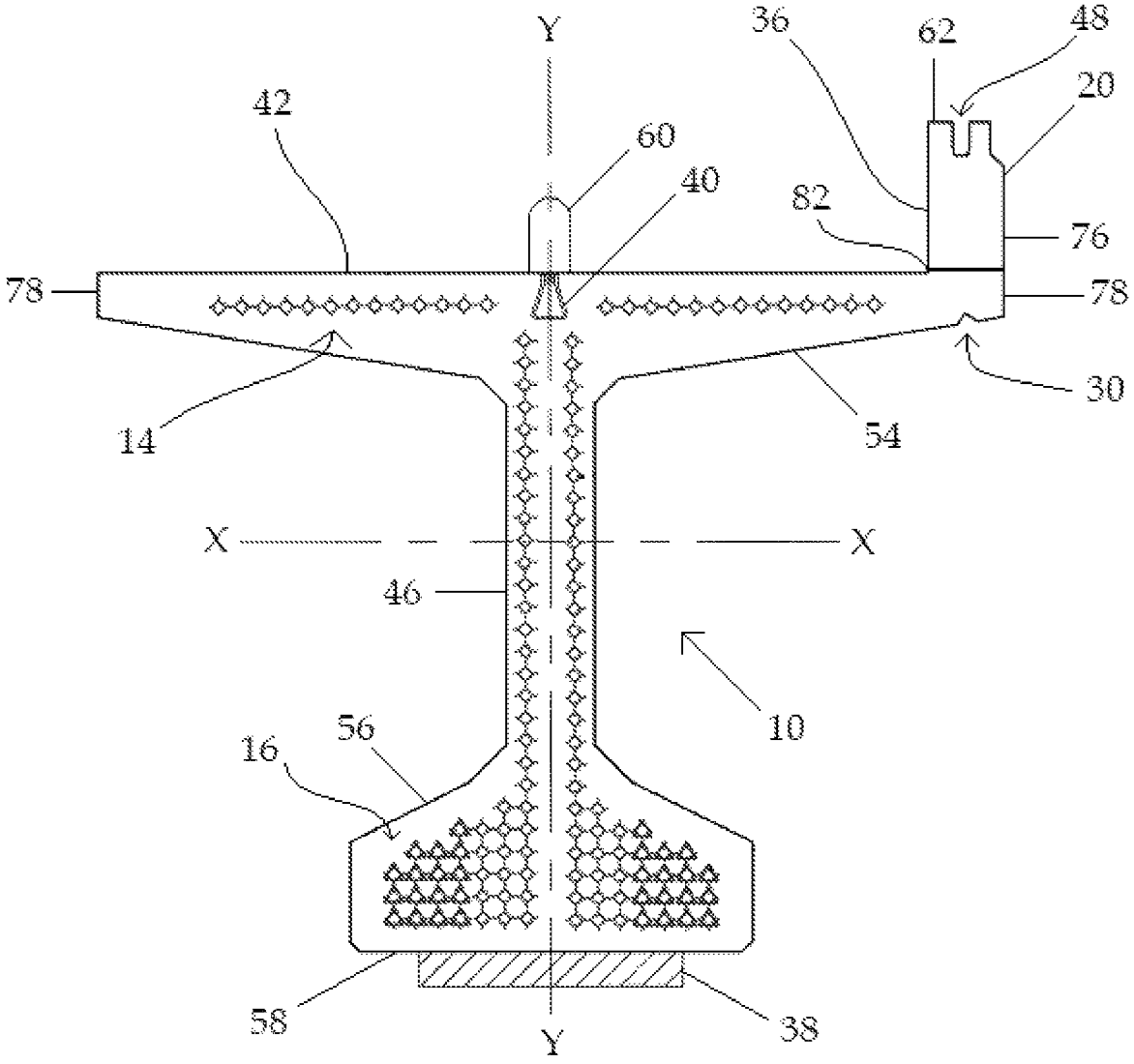
FIG. 12 is a front, cut-away view of an embodiment of the girder illustrating a construction joint.

FIG. 12 is a cutaway of a front view of the girder 10 illustrating a permissible construction joint 82 located between the form 20 and the top flange 14.

Unless otherwise specifically noted, articles depicted in the drawings not necessarily drawn to scale, however the drawings are illustrative and do indicate relative size and relative positioning or placement.

Throughout this disclosure, the reference numeral refers to the element generically or collectively. If an element has secondary elements, such as multiple sides, edges, or the like, then the first of such secondary elements is designated as "a," the second of such secondary elements is designated as "b," and so on. So, for clarification and as an example only, if a Widget is designated as 20, then the class of Widgets may be referred to collectively as Widgets 20 and any one of which may be referred to generically as a Widget 20, while a Widget First Edge would be designated 20*a*, while Widget Third Edge would be designated 20*c*.

When the terms "substantially," "approximately," "about," or "generally" are used herein to modify a numeric value, range of numeric values, or list numeric values, the term modifies each of the numerals. Unless otherwise indicated, all numbers expressing quantities, units, percentages, and the like used in the present specification and associated claims are to be understood as being modified in all instances by the terms "approximately," "about," and "generally." As used herein, the term "approximately" encompasses +/−5 of each numerical value. For example, if the numerical value is "approximately 80," then it can be 80 +/−5, equivalent to 75 to 85. As used herein, the term "about" encompasses +/−10 of each numerical value. For example, if the numerical value is "about 80," then it can be 80+/−10, equivalent to 70 to 90. As used herein, the term "generally" encompasses +/−15 of each numerical value. For example, if the numerical value is "about 80," then it can be 80% +/−15, equivalent to 65 to 95. Accordingly, unless indicated to the contrary, the numerical parameters (regardless of the units) set forth in the following specification and attached claims are approximations that may vary depending upon the desired properties sought to be obtained by the exemplary embodiments described herein. In some ranges, it is possible that some of the lower limits (as modified) may be greater than some of the upper limits (as modified), but one skilled in the art will recognize that the selected subset will require the selection of an upper limit in excess of the selected lower limit.

At the very least, and not limiting the application of the doctrine of equivalents to the scope of the claim, each numerical parameter should at least be construed in light of the number of reported significant digits and by applying ordinary rounding techniques.

The terms "inhibiting" or "reducing" or any variation of these terms refer to any measurable decrease, or complete inhibition, of a desired result. The terms "promote" or "increase" or any variation of these terms includes any measurable increase, or completion, of a desired result.

The term "effective," as that term is used in the specification and/or claims, means adequate to accomplish a desired, expected, or intended result.

The terms "a" or "an" when used in conjunction with the term "comprising" in the claims and/or the specification may mean "one," but it is also consistent with the meaning of "one or more," "at least one," and "one or more than one."

The term "each" refers to each member of a set, or each member of a subset of a set.

The terms "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

In interpreting the claims appended hereto, it is not intended that any of the appended claims or claim elements invoke 35 U.S.C. 112(f) unless the words "means for" or "step for" are explicitly used in the particular claim.

It should be understood that, although exemplary embodiments are illustrated in the figures and description, the principles of the present disclosure may be implemented using any number of techniques, whether currently known or not. The present disclosure should in no way be limited to the exemplary implementations and techniques illustrated in the drawings and description herein. Thus, although the invention has been described with reference to specific embodiments, this description is not meant to be construed in a limited sense. Various embodiments may include some, none, or all of the enumerated advantages. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention. Modifications, additions, or omissions may be made to the systems, apparatuses, and methods described herein without departing from the scope of the disclosure. For example, the operations of the systems and apparatuses disclosed herein may be performed by more, fewer, or other components in the methods described may include more, fewer, or other steps. Additionally, steps may be performed in any suitable order.

We claim:

1. A method of building a bridge, comprising:

attaching a first outer girder, having a first integrated form on a first top flange, to a first upper side of said bridge and adjacent to a first outer side of said bridge, wherein said first integrated form is positioned adjacent to said first outer side of said bridge;

attaching a second outer girder, having a second integrated form on a second top flange, to a second upper side of said bridge and adjacent to a second outer side of said bridge, wherein said second integrated form is positioned adjacent to said second outer side of said bridge;

wherein said first outer girder, first integrated form, second outer girder, and second integrated form each being comprised of concrete;

the first and second integrated forms each having a multiplicity of apertures in a top of said first integrated form and a top of said second integrated form;

at least some of said apertures in each said first and second integrated forms are located along the length of the top of the first and second integrated forms and are equidistant from other said apertures;

attaching a first safety rail having an upper vertical portion and lower posts to the first integrated form by inserting the safety rail's lower posts into said apertures, the apertures being located, sized, and shaped, and the safety rail posts being located, sized and shaped so the posts fit within the apertures and extend downward through the apertures into the body of the first integrated form;

attaching a second safety rail having an upper vertical portion and lower posts to the $2^{nd}$ integrated form by inserting the second safety rail's lower posts into said apertures, the apertures being located, sized, and shaped, and the second safety rail posts being located, sized and shaped so the posts fit within the apertures and extend downward through the apertures into the body of the second integrated form;

attaching an interior girder to a third upper side of said bridge and between said first and second outer girders;

placing one or more deck panels such that they span any spaces between girders from said first outer girder to said second outer girder;

pouring slurry concrete on said deck panel, said first outer girder, and said second outer girder, and between said first form and said second form, the first and second forms each retaining the slurry concrete between them without use of a removable slurry concrete retainer on the bridge's sides;

curing the slurry concrete in place; and completing said bridge construction without attaching support brackets to support a walkway off an outer edge of said bridge.

2. The method of claim 1 wherein said bridge is completed without removing said walkway retainer brackets from said bridge.

3. A girder for use in building a bridge, comprising:

said girder having a height, a width, and a span;

wherein said girder is comprised of a top flange with a deck and an underside, a bottom flange, and a web;

wherein said top flange is connected opposite of said deck at or near a center of a width of said top flange to a first end of said web;

wherein said bottom flange is connected at or near a center of a width of said bottom flange to a second end of said web;

wherein said web first end is opposite of said web second end;

a form;

wherein said girder and said form are manufactured from concrete;

wherein said form is manufactured as an integral part of said top flange;

wherein said form is located on said deck and adjacent to a first edge of said top flange, such that said form extends upwardly above said deck;

wherein said form has an aperture at a top of said form for receiving a safety rail.

4. The girder of claim 3, wherein there are a multiplicity of said apertures equidistantly interspersed along a length of the top of said form.

5. The girder of claim 4, further comprising said safety rail having an upper vertical portion and lower posts; the apertures are located, sized, and shaped, and the safety rail posts are located, sized, and shaped so at least some of the posts fit within at least some of the apertures and extend downward through the apertures into the form; at least some of the posts are inserted into at least some of the apertures and hold the safety rail above said form, and the upper vertical portion of the safety rail extends vertically above the top of the form, and the top of the upper vertical portion of the safety rail is further away from the deck than the top of the form.

6. A girder for use in building a bridge, comprising:

said girder having a height, a width, and a span;

wherein said girder is comprised of a top flange with a deck and an underside, a bottom flange, and a web;

wherein said top flange is connected opposite of said deck at or near a center of a width of said top flange to a first end of said web;

wherein said bottom flange is connected at or near a center of a width of said bottom flange to a second end of said web;

wherein said web first end is opposite of said web second end;

a form;

wherein said girder and said form are manufactured from concrete;

wherein said form is manufactured as an integral part of said top flange;

wherein said form is located on said deck and adjacent to a first edge of said top flange, such that said form extends upwardly above said deck; and a construction joint located between said form and said top flange.

7. The girder of claim 6, wherein said form has an aperture for receiving a safety rail.

8. The girder of claim 7, wherein there are a multiplicity of said apertures interspersed along the top of said form.

9. The girder of claim 8, further comprising said safety rail engaged with said apertures.

10. A girder for use in building a bridge, comprising:

said girder having a height, a width, and a span;

wherein said girder is comprised of a top flange with a deck and an underside, a bottom flange, a first web, and a second web;

wherein said top flange is connected opposite of said deck at or near a first end of said top flange to a first end of said first web;

wherein said top flange is connected opposite of said deck at or near a second end of said top flange to a first end of said second web;

wherein said bottom flange is connected at or near a first end of said bottom flange to a second end of said first web;

wherein said bottom flange is connected at or near a second end of said bottom flange to a second end of said second web;

wherein the top flange, bottom flange, first web, and second web generally have an box beam cross-section;

a form;

wherein said girder and said form are manufactured from concrete;

wherein said form is manufactured as an integral part of said top flange; and wherein said form is located on said deck and adjacent to one of said first end or said second end of said top flange, such that said form extends upwardly above said deck.

11. The girder of claim 10, wherein said form has an aperture for receiving a safety rail.

12. The girder of claim 11, wherein there are a multiplicity of said apertures interspersed along the top of said form.

13. The girder of claim 12, further comprising said safety rail engaged with said apertures.

14. A precast concrete girder for use in building a bridge, said girder comprising:

a height, a width, and a span, a top flange with a top flange deck and a top flange underside, a bottom flange with a bottom flange topside and a bottom flange underside, a web, and a form, said girder and its listed components being manufactured as a single unit; wherein said top flange underside is connected at or near a center of said top flange underside to a first end of said web, wherein said bottom flange topside is connected at or near a center of said bottom flange topside to a second end of said web; the girder comprising;

said girder is a precast concrete structural unit, being manufactured as a single precast concrete unit;

said form:

wherein said form is located on the upper side of said top flange deck and adjacent to a said first or second end of said top flange and extends upwardly above said top flange deck to a form top;

wherein said form is a precast concrete portion of said precast concrete girder, being manufactured as a portion of said precast concrete girder;

wherein said form has a multiplicity of precast apertures located near a center of said form top, said apertures extending downward into said form;

at least some of said apertures are located along the length of said form and not at ends of said form and are equidistant from other of said apertures;

a safety rail, having an upper vertical portion and lower posts;

the apertures are located, sized, and shaped, and the safety rail posts are located, sized, and shaped so at least some of the posts fit within at least some of the apertures and extend downward through the apertures into said form;

at least some of the posts are inserted into at least some of the apertures and hold the safety rail above said form, and the upper vertical portion of the safety rail extends vertically above the form top, and the top of the upper vertical portion of the safety rail is further away from the top flange deck than the top of the form.

15. The girder of claim 14, further comprising the top of the upper vertical portion of the safety rail, is at least three times farther away from the top flange deck than the form top is away from the top flange deck.

16. The girder of claim 14, further comprising the safety rail making unnecessary the installation of temporary walkways outside said form during building said bridge.

17. The girder of claim 14, further comprising a construction joint between said form and said top flange deck.

* * * * *